US005830007A

United States Patent [19]

Fry et al.

[11] Patent Number: 5,830,007

[45] Date of Patent: Nov. 3, 1998

[54] ELECTRICAL CONNECTOR FOR A MICROPHONE

[75] Inventors: Rupert J. Fry, Mount Prospect; Keith Samuel Maranto, Frankfort, both of Ill.

[73] Assignee: Molex Incorporated, Lisle, Ill.

[21] Appl. No.: 811,357

[22] Filed: Mar. 4, 1997

[51] Int. Cl.[6] ..... H01R 3/00

[52] U.S. Cl. ..... 439/500; 439/356; 439/929; 439/626

[58] Field of Search ..... 439/500, 63, 581, 439/626, 627, 660, 356, 929; 429/96, 97, 100

[56] References Cited

U.S. PATENT DOCUMENTS 4,273,399 6/1981 Myers et al. ..... 439/74
4,578,545 3/1986 Phillipson ..... 439/743
5,201,069 4/1993 Barabolak ..... 455/90
5,552,240 9/1996 Derstine ..... 429/96
5,586,907 12/1996 Frantz et al. ..... 439/500

*Primary Examiner*—Neil Abrams
*Assistant Examiner*—T. C. Patel
*Attorney, Agent, or Firm*—Stephen Z. Weiss

[57] ABSTRACT

An electrical connector is provided for mounting a microphone of the disc type which has opposite flat faces joined by a cylindrical periphery. The connector includes a dielectric housing having a cylindrical microphone insertion cavity defined by a rigid arcuate wall portion at one side of the cavity and a flexible wall portion at an opposite side of the cavity. The distance between the rigid arcuate wall portion and the flexible wall portion is less than the diameter of the disc shaped microphone so that the flexible wall portion resiliently engages the cylindrical periphery of the microphone to establish an interference fit therewith. Terminals project into the cavity for engaging appropriate mating terminals on the microphone.

13 Claims, 3 Drawing Sheets

ELECTRICAL CONNECTOR FOR A MICROPHONE

FIELD OF THE INVENTION

This invention generally relates to the art of electrical connectors and, particularly, to an electrical connector for mounting a microphone, such as a microphone of the disc type which has opposite flat faces joined by a cylindrical periphery.

BACKGROUND OF THE INVENTION

A variety of communication devices presently are being used extensively in a wide range of applications. Communication devices typically include a microphone enabling a user to send or receive audible messages. Generally, the microphone is a small device which, in essence, is a transmit electroacoustic transducer that converts acoustic signals into electrical signals. Consequently, electrical connectors are used to mount the microphone electrically connected to terminals of the connector. One use of such devices is in telephone handset systems, particularly for use in portable or mobile telephone systems.

One type of microphone for use in applications as described above is a disc type microphone which has opposite flat faces joined by a cylindrical periphery. One flat face of the microphone forms the speaker, and a center positive terminal is disposed on the opposite flat face. The cylindrical periphery of the microphone typically is formed by a metal shell which forms the negative terminal of the microphone.

Various problems are encountered in designing electrical connectors for disc-type microphones as described above. For instance, although the diameters of such microphones are fairly standard, the microphones are manufactured in different heights or depths. This requires expensive maintenance of customized inventory. Other problems involve potential overstressing of the connector terminals, as well as the complexity in assembling an otherwise relatively simple connector. The present invention is directed to a simplified connector design which solves these problems.

SUMMARY OF THE INVENTION

An object, therefore, of the invention is to provide a new and improved electrical connector for mounting a microphone of the disc type which has opposite flat faces joined by a cylindrical periphery.

In the exemplary embodiment of the invention, the connector includes a dielectric housing having a generally cylindrical microphone insertion cavity defined by a rigid arcuate wall portion at one side of the cavity and a flexible wall portion at an opposite side of the cavity. The distance between the rigid arcuate wall portion and the flexible wall portion is less than the diameter of the disc shaped microphone so that the flexible wall portion resiliently engages the cylindrical periphery of the microphone to establish an interference fit therewith. Generally, terminal means project into the cavity for engaging appropriate terminals on the microphone.

As disclosed herein, the rigid arcuate wall portion of the cylindrical microphone insertion cavity extends approximately 180° about the circumference of the cavity. The flexible wall portion is formed by a cantilevered arm having a length on the order of the depth of the cavity which, preferably, is less than the width of the cylindrical periphery of the microphone between the opposite flat faces thereof.

The cantilevered arm has a radially inwardly directed projection near a distal end thereof for engaging the cylindrical periphery of the microphone.

The terminal means include at least one flexible terminal located in the bottom of the cavity and projecting inwardly thereinto. A stop shoulder is formed in the cavity for limiting the insertion depth of the microphone to prevent overstressing the flexible terminal. As disclosed herein, the one flexible terminal projects radially into one side of the cylindrical cavity generally on a diameter thereof for engaging the center positive terminal of the microphone. The stop shoulder is generally C-shaped about the terminal. A second terminal projects generally tangentially into the cylindrical cavity for engaging the negative metal shell at the periphery of the microphone.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
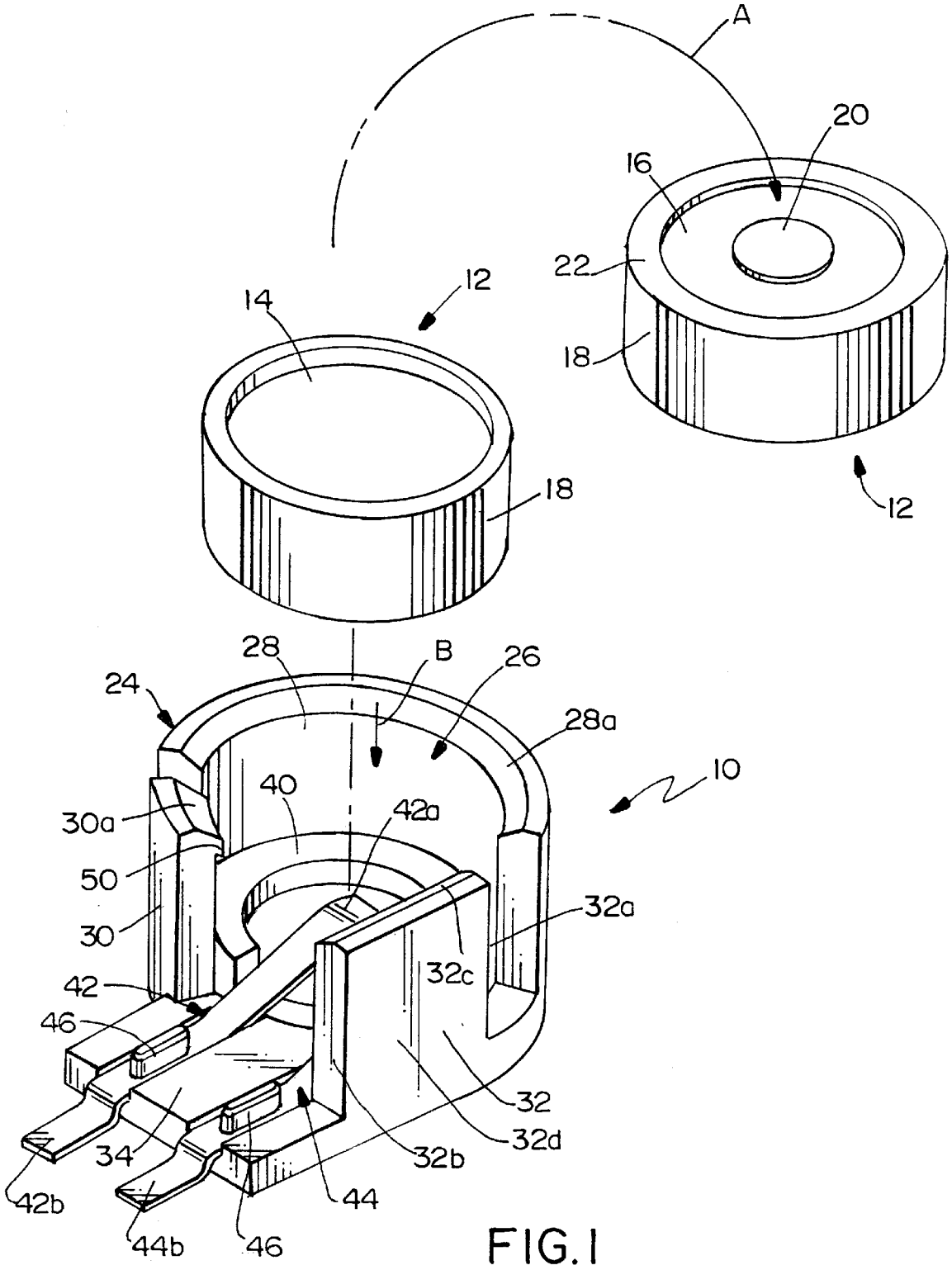
FIG. 1 is a perspective view of the electrical connector according to the invention, with a microphone elevated above the connector as well as showing the microphone flipped over to illustrate its terminals.

Referring to the drawings in greater detail, and first to FIG. 1, the invention is embodied in an electrical connector, generally designated 10, for mounting a microphone, generally designated 12. The microphone is of a conventional disc type which has opposite flat faces 14 and 16 joined by a cylindrical periphery 18. Flat face 14 is the top face of the microphone when mounted in connector 10. Face 16 is the bottom face of the microphone when it is flipped over as shown by arrow "A" in FIG. 1. A center positive terminal 20 is located in the center of bottom face 16, and periphery 18 is formed by a metal shell which forms the negative terminal of the microphone. The shell has at least a bottom circular lip 22 inwardly turned over bottom face 16 for engaging one of the terminals of the connector, as described hereinafter.

Electrical connector 10 is an extremely simple structure and is formed by a one-piece housing, generally designated 24, which is unitarily molded of dielectric material such as plastic or the like. The housing forms a cylindrical microphone insertion cavity, generally designated 26. The cavity is defined by a rigid arcuate wall portion 28 at one side of the cavity and a flexible wall portion 30 at an opposite side of the cavity. A third wall, straight portion 32 projects generally tangentially away from the cavity, whereby an inner end 32*a* of the wall portion defines part of the cavity but an outer end 32*b* of the wall portion is outside the cavity to define a support wall for one of the terminals, as described hereinafter. Outer surface 32*d* of the wall portion 32 provides a flat surface used in automated assembly machinery to automatically orient the housing 24 during assembly.

Figure 2:
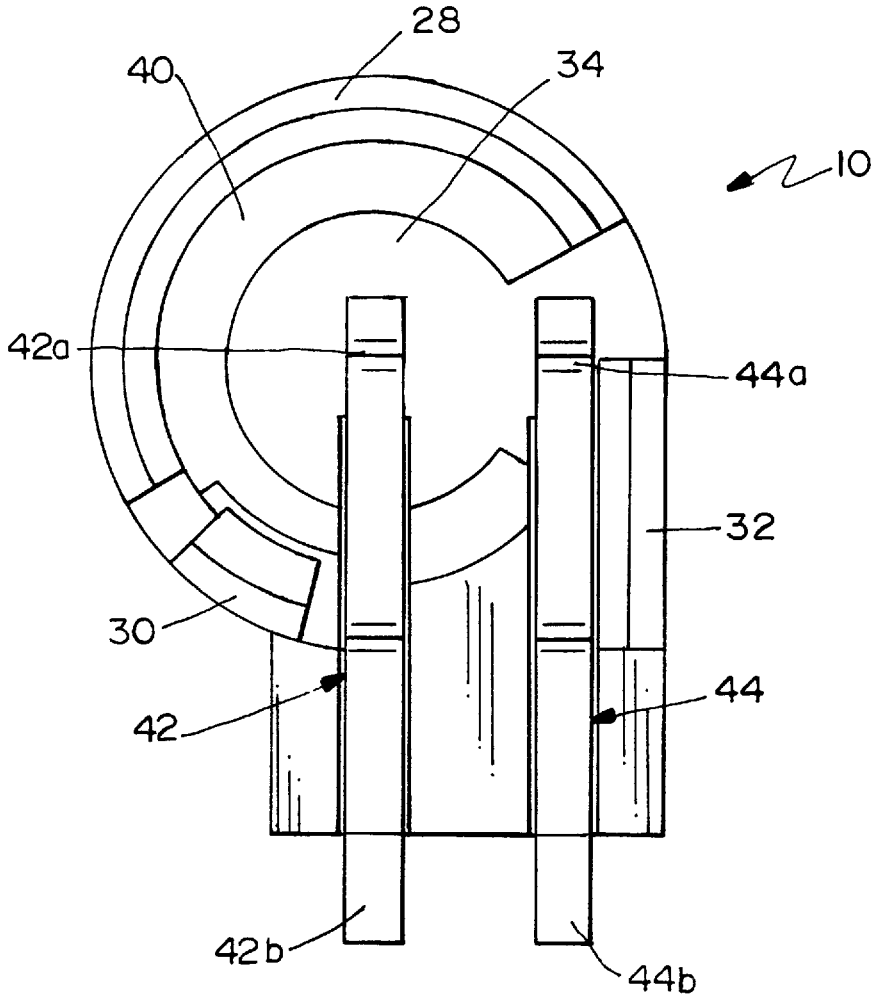
FIG. 2 is a top plan view of the connector.
Figure 3:
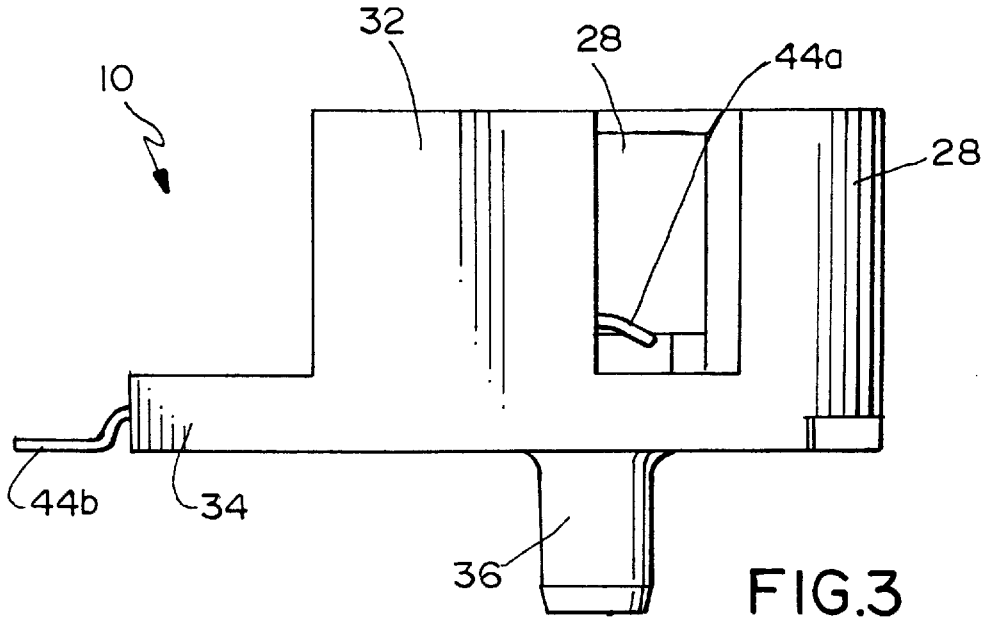
FIG. 3 is a side elevational view of the connector looking toward the right-hand side of FIG. 2.
Figure 4:
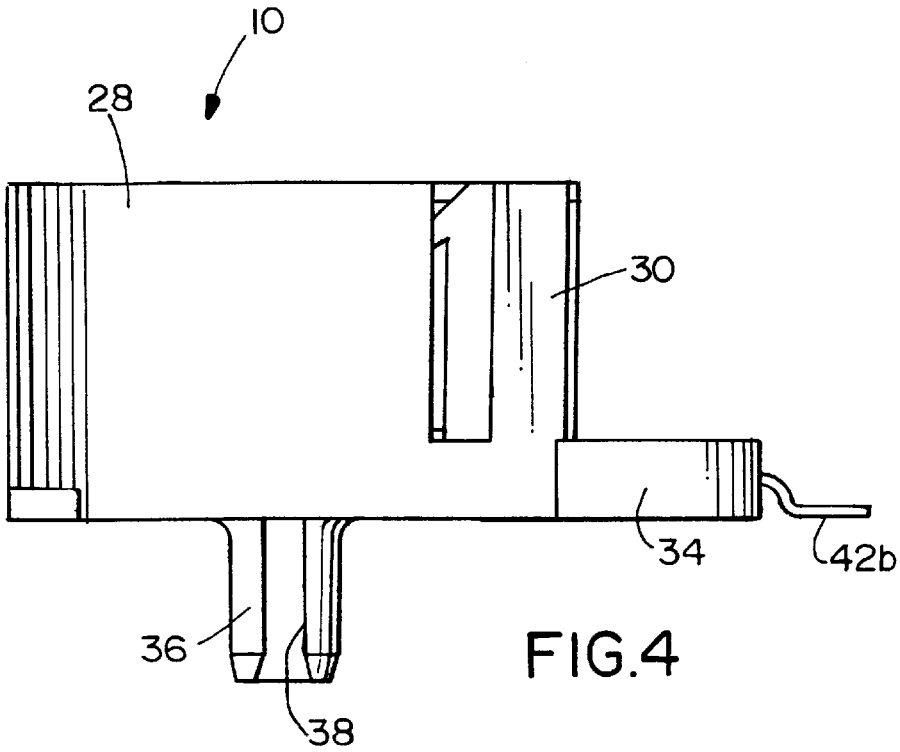
FIG. 4 is a side elevational view of the connector looking toward the left-hand side of FIG. 2.
Figure 5:
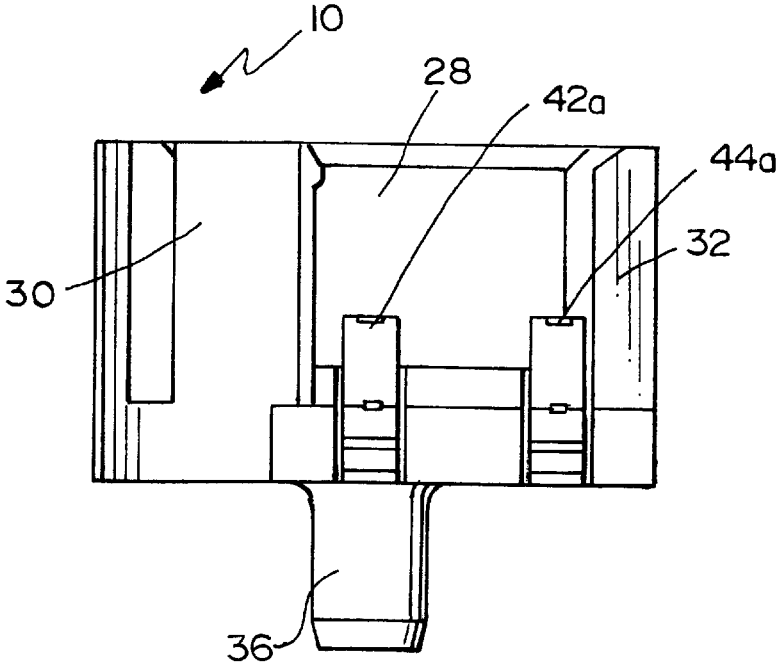
FIG. 5 is a front elevational view of the connector looking in the direction that the terminals enter the connector cavity.

One-piece housing 24 of connector 10 has a generally flat base 34 which, as seen in FIGS. 3–5, includes a mounting post 36 depending from the underside of the connector for insertion into an appropriate mounting hole in a printed circuit board. As seen in FIG. 4, mounting post 36 is axially slit, as at 38, to provide a C-shaped cross section therefor which, in turn, provides resiliency for the mounting post. As seen best in FIGS. 1 and 2, a raised, C-shaped shoulder 40 surrounds a portion of the bottom of cavity 26 to provide a stop shoulder which limits the insertion depth of microphone 12 to prevent overstressing of the terminals of the connector.

Generally, terminal means are provided on connector housing 24 projecting into cavity 26 for engaging center positive terminal 20 and circular lip 22 of negative shell 18 of the microphone. More particularly, as best seen in FIGS. 1 and 2, a center terminal, generally designated 42, and a side terminal, generally designated 44, are mounted on the housing. The terminals are stamped and formed of sheet metal material to have inherent flexibility. The terminals are located in the bottom of cavity 26, and center terminal 42 has a flexible contact portion 42*a* which projects radially into the cylindrical cavity generally on a diameter thereof for engaging center positive terminal 20 of the microphone. Side terminal 44 has a flexible contact portion 44*a* (FIG. 2) which projects generally tangentially into the cylindrical cavity for engaging circular lip 22 of the negative shell/terminal of the microphone. Terminals 42 and 44 have solder tail portions 42*b* and 44*b*, respectively, for engaging appropriate circuit traces on the printed circuit board, as by soldering. The terminals are rigidly mounted to base 34 of housing 24 by raised bosses 46 (FIG. 1) projecting through complementarily shaped apertures in the terminals, and the bosses are cold staked (not shown) over the terminals about the apertures to rigidly fix the terminals to the housing.

Rigid arcuate wall portion 28 of cylindrical microphone insertion cavity 22 extends approximately 180° about the circumference of the cavity as best seen in FIGS. 1 and 2. Flexible wall portion 30 is formed as a cantilevered arm upstanding from base 34 and having a length on the order of the depth of the cavity. The cantilevered arm has a radially inwardly directed projection 50 (FIG. 1) near its distal end for engaging the cylindrical periphery 18 of microphone 12. Preferably, the depth of cavity 26, which would include the distance from the top of stop shoulder 40 to projection 50, is less than the width of cylindrical periphery 18 of the microphone between opposite flat faces 14 and 16 thereof. Therefore, projection 50 of flexible wall portion 30 resiliently engages cylindrical periphery 18 of the microphone to establish an interference fit therewith and, consequently, various sizes of microphones having standard diameters can be accommodated by the connector of the invention with a flat face 14 always exceeding the height of the top of the housing 24 when the microphone 12 is fully seated with face 16 in contact with C-shaped shoulder 40.

Lastly, rigid arcuate wall portion 28, flexible wall portion 30 and straight wall portion 32 have chamfered upper inner edges, as at 28*a*, 30*a* and 32*c*, respectively, to facilitate guiding microphone 12 into cavity 26. The microphone is inserted into the cavity in the direction of arrow "B" (FIG. 1).

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector for mounting a microphone of the disc type which has opposite flat faces joined by a cylindrical periphery, comprising:

a dielectric housing having a generally cylindrical microphone insertion cavity defined by a rigid arcuate wall portion at one side of the cavity a flexible wall portion at an opposite side of the cavity an open axial end and a closed axial end, the flexible wall portion extending perpendicular from the closed axial end, the distance between the rigid arcuate wall portion and the flexible wall portion being less than the diameter of the disc shaped microphone so that the flexible wall portion resiliently engages the cylindrical periphery of the microphone to establish an interference fit therebetween the microphone adapted to be inserted into the cavity axially through the open axial end; and terminal means projecting into the cavity for engaging appropriate terminals on the microphone.

2. The electrical connector of claim 1 wherein said rigid arcuate wall portion of the cylindrical microphone insertion cavity extends approximately 180° about the circumference of the cavity.

3. The electrical connector of claim 1 wherein said flexible wall portion comprises a cantilevered arm having a length on the order of the depth of the cavity.

4. The electrical connector of claim 1 wherein said flexible wall portion comprises a cantilevered arm having a radially inwardly directed projection near a distal end thereof for engaging the cylindrical periphery of the microphone.

5. The electrical connector of claim 1 wherein the depth of said microphone insertion cavity is less than the width of the cylindrical periphery of the microphone between said opposite flat faces thereof.

6. The electrical connector of claim 1 wherein said terminal means include at least one flexible terminal located in the bottom of the cavity and projecting upwardly thereinto, and including a stop shoulder in the cavity for limiting the insertion depth of the microphone to prevent overstressing the flexible terminal.

7. The electrical connector of claim 6 wherein said one flexible terminal projects radially into one side of the cylindrical cavity generally on a diameter thereof, and said stop shoulder is generally C-shaped.

8. The electrical connector of claim 7 wherein said terminal means includes a second terminal projecting generally tangentially into the cylindrical cavity.

9. An electrical connector for mounting a microphone of the disc type which has opposite flat faces joined by a cylindrical periphery, comprising:

a dielectric housing having a generally cylindrical microphone insertion cavity defined by a rigid arcuate wall portion at one side of the cavity, a flexible wall portion at an opposite side of the cavity, an open axial end and a closed axial end, the flexible wall portion extending perpendicular from the closed axial end the distance between the rigid arcuate wall portion and the flexible wall portion being less than the diameter of the disc shaped microphone, the flexible wall portion being formed by a cantilevered arm having a radially inwardly directed projection near a distal end thereof for engaging the cylindrical periphery of the microphone between said opposite flat faces thereof whereby the inwardly directed projection resiliently engages the cylindrical periphery of the microphone to establish an interference fit therebetween, the microphone adapted to be inserted into the cavity axially through the open axial end; and terminal means projecting into the cavity for engaging appropriate terminals on the microphone.

10. The electrical connector of claim 9 wherein said rigid arcuate wall portion of the cylindrical microphone insertion cavity extends approximately 180° about the circumference of the cavity.

11. The electrical connector of claim 9 wherein said terminal means include at least one flexible terminal located in the bottom of the cavity and projecting upwardly thereinto, and including a stop shoulder in the cavity for limiting the insertion depth of the microphone to prevent overstressing the flexible terminal.

12. The electrical connector of claim 11 wherein said one flexible terminal projects radially into one side of the cylindrical cavity generally on a diameter thereof, and said stop shoulder is generally C-shaped.

13. The electrical connector of claim 12 wherein said terminal means includes a second terminal projecting generally tangentially into the cylindrical cavity.

* * * * *